US006827845B2

(12) United States Patent
Gong et al.

(10) Patent No.: US 6,827,845 B2
(45) Date of Patent: Dec. 7, 2004

(54) PREPARATION OF COMPONENTS FOR REFINERY BLENDING OF TRANSPORTATION FUELS

(75) Inventors: William H. Gong, Elmhurst, IL (US); Monica Cristina Regalbuto, Glenview, IL (US); George A. Huff, Jr., Naperville, IL (US)

(73) Assignee: BP Corporation North America Inc., Warrenville, IL (US)

( * ) Notice: Subject to any disclaimer, the term of this patent is extended or adjusted under 35 U.S.C. 154(b) by 76 days.

(21) Appl. No.: 09/779,285

(22) Filed: Feb. 8, 2001

(65) Prior Publication Data

US 2002/0144932 A1 Oct. 10, 2002

(51) Int. Cl.[7] ..... C10G 67/02; C10G 67/12; C10G 67/14

(52) U.S. Cl. ..... 208/212; 208/208 R; 208/219; 208/221; 208/240; 208/254 R

(58) Field of Search ..... 208/212, 208 R, 208/219, 221, 240, 254 R

(56) References Cited

U.S. PATENT DOCUMENTS

| | | | | | |
|---|---|---|---|---|---|
| 1,972,102 | A | * | 9/1934 | Malisoff | 208/219 |
| 3,163,593 | A | * | 12/1964 | Webster et al. | 208/208 R |
| 3,341,448 | A | * | 9/1967 | Ford et al. | 208/196 |
| 3,413,307 | A | * | 11/1968 | Heimlich et al. | 208/196 |
| 3,505,210 | A | * | 4/1970 | Wallace et al. | 208/210 |
| 6,171,478 | B1 | | 1/2001 | Cabrera et al. | 208/212 |
| 6,217,748 | B1 | * | 4/2001 | Hatanaka et al. | 208/196 |
| 6,274,785 | B1 | * | 8/2001 | Gore | 585/833 |
| 6,402,940 | B1 | * | 6/2002 | Rappas | 208/196 |
| 6,406,616 | B1 | * | 6/2002 | Rappas et al. | 208/196 |

FOREIGN PATENT DOCUMENTS

| | | | | |
|---|---|---|---|---|
| DE | 4200376 | | 7/1993 | C10G/53/14 |
| GB | 2262942 A | * | 7/1993 | C10G/27/04 |

* cited by examiner

*Primary Examiner*—Walter D. Griffin
(74) *Attorney, Agent, or Firm*—Ekkehard Schoettle

(57) ABSTRACT

Economical processes are disclosed for the production of components for refinery blending of transportation fuels by selective oxidation of feedstocks comprising a mixture of hydrocarbons, sulfur-containing and nitrogen-containing organic compounds. Oxidation feedstock is contacted with an immiscible phase comprising at least one organic peracid or precursors of organic peracid in a liquid phase reaction mixture maintained substantially free of catalytic active metals and/or active metal-containing compounds and under conditions suitable for oxidation of one or more of the sulfur-containing and/or nitrogen-containing organic compounds. Blending components containing less sulfur and/or less nitrogen than the oxidation feedstock are recovered from the reaction mixture. Advantageously, at least a portion of the immiscible acid-containing phase is recycled to the oxidation.

13 Claims, 1 Drawing Sheet

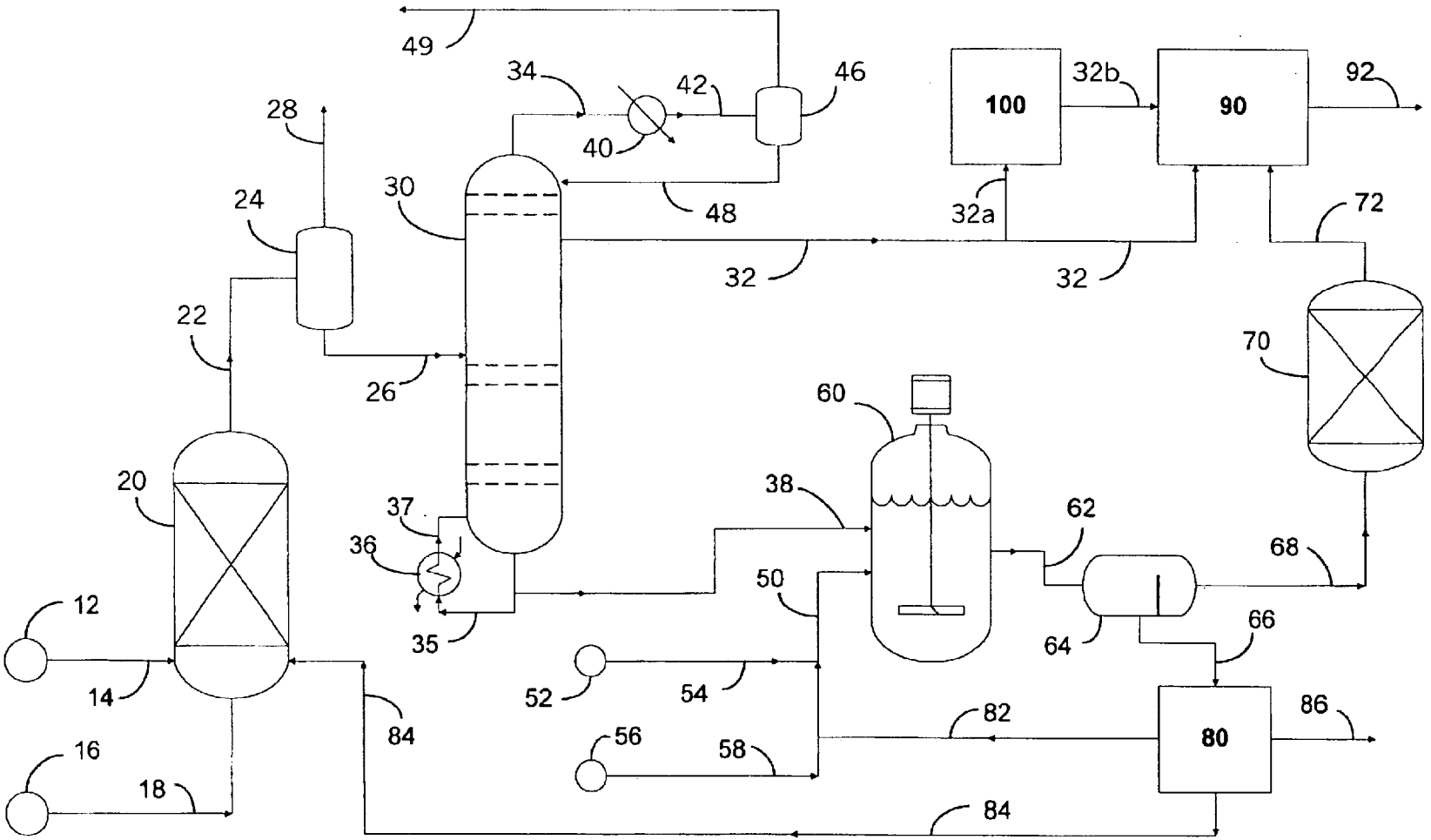
92
72
90
32b
100
32a
32
32
46
42
40
48
34
49
30
26
28
24
22
20
12
14
18
16
70
68
66
86
80
62
64
60
38
50
82
84
54
58
56
52
35
37
36
84

PREPARATION OF COMPONENTS FOR REFINERY BLENDING OF TRANSPORTATION FUELS

TECHNICAL FIELD

The present invention relates to fuels for transportation which are derived from natural petroleum, particularly processes for the production of components for refinery blending of transportation fuels which are liquid at ambient conditions. More specifically, it relates to integrated processes which include selective oxidation of a petroleum distillate whereby the incorporation of oxygen into hydrocarbon compounds, sulfur-containing organic compounds, and/or nitrogen-containing organic compounds assists by oxidation removal of sulfur and/or nitrogen from components for refinery blending of transportation fuels which are friendly to the environment.

The oxidation feedstock is contacted with an immiscible phase comprising at least one organic peracid or precursors of organic peracid in a liquid phase reaction mixture. Maintaining the reaction mixture substantially free of catalytic active metals and/or active metal-containing compounds is an essential element of the invention. Blending components containing less sulfur and/or less nitrogen than the oxidation feedstock are recovered from the reaction mixture. Advantageously, at least a portion of the immiscible peracid-containing phase is also recovered from the reaction mixture and recycled to the oxidation. Integrated processes of this invention may also provide their own source of high-boiling oxidation feedstock derived from other refinery units, for example, by hydrotreating a petroleum distillate.

Beneficially, the instant oxidation process is very selective, i.e. preferentially compounds in which a sulfur atom the sterically hindered are oxidized rather than aromatic hydrocarbons. Products can be used directly as transportation fuels, blending components, and/or fractionated, as by further distillation, to provide, for example, more suitable components for blending into diesel fuels.

BACKGROUND OF THE INVENTION

It is well known that internal combustion engines have revolutionized transportation following their invention during the last decades of the 19th century. While others, including Benz and Gottleib Wilhelm Daimler, invented and developed engines using electric ignition of fuel such as gasoline, Rudolf C. K. Diesel invented and built the engine named for him which employs compression for auto-ignition of the fuel in order to utilize low-cost organic fuels. Development of improved diesel engines for use in transportation has proceeded hand-in-hand with improvements in diesel fuel compositions. Modern high performance diesel engines demand ever more advanced specification of fuel compositions, but cost remains an important consideration.

At the present time most fuels for transportation are derived from natural petroleum. Indeed, petroleum as yet is the world's main source of hydrocarbons used as fuel and petrochemical feedstock. While compositions of natural petroleum or crude oils are significantly varied, all crudes contain sulfur compounds and most contain nitrogen compounds which may also contain oxygen, but oxygen content of most crudes is low. Generally, sulfur concentration in crude is less than about 8 percent, with most crudes having sulfur concentrations in the range from about 0.5 to about 1.5 percent. Nitrogen concentration is usually less than 0.2 percent, but it may be as high as 1.6 percent.

Crude oil seldom is used in the form produced at the well, but is converted in oil refineries into a wide range of fuels and petrochemical feedstocks. Typically fuels for transportation are produced by processing and blending of distilled fractions from the crude to meet the particular end use specifications. Because most of the crudes available today in large quantity are high in sulfur, the distilled fractions must be desulfurized to yield products which meet performance specifications and/or environmental standards. Sulfur containing organic compounds in fuels continue to be a major source of environmental pollution. During combustion they are converted to sulfur oxides which, in turn, give rise to sulfur oxyacids and, also, contribute to particulate emissions.

Even in newer, high performance diesel engines combustion of conventional fuel produces smoke in the exhaust. Oxygenated compounds and compounds containing few or no carbon-to-carbon chemical bonds, such as methanol and dimethyl ether, are known to reduce smoke and engine exhaust emissions. However, most such compounds have high vapor pressure and/or are nearly insoluble in diesel fuel, and they have poor ignition quality, as indicated by their cetane numbers. Furthermore, other methods of improving diesel fuels by chemical hydrogenation to reduce their sulfur and aromatics contents, also causes a reduction in fuel lubricity. Diesel fuels of low lubricity may cause excessive wear of fuel injectors and other moving parts which come in contact with the fuel under high pressures.

Distilled fractions used for fuel or a blending component of fuel for use in compression ignition internal combustion engines (Diesel engines) are middle distillates that usually contain from about 1 to 3 percent by weight sulfur. In the past a typical specifications for Diesel fuel was a maximum of 0.5 percent by weight. By 1993 legislation in Europe and United States limited sulfur in Diesel fuel to 0.3 weight percent. By 1996 in Europe and United States, and 1997 in Japan, maximum sulfur in Diesel fuel was reduced to no more than 0.05 weight percent. This world-wide trend must be expected to continue to even lower levels for sulfur.

In one aspect, pending introduction of new emission regulations in California and Federal markets has prompted significant interest in catalytic exhaust treatment. Challenges of applying catalytic emission control for the diesel engine, particularly the heavy-duty diesel engine, are significantly different from the spark ignition internal combustion engine (gasoline engine) due to two factors. First, the conventional three way catalyst (TWC) catalyst is ineffective in removing NOx emissions from diesel engines, and second, the need for particulate control is significantly higher than with the gasoline engine.

Several exhaust treatment technologies are emerging for control of Diesel engine emissions, and in all sectors the level of sulfur in the fuel affects efficiency of the technology. Sulfur is a catalyst poison that reduces catalytic activity. Furthermore, in the context of catalytic control of Diesel emissions, high fuel sulfur also creates a secondary problem of particulate emission, due to catalytic oxidation of sulfur and reaction with water to form a sulfate mist. This mist is collected as a portion of particulate emissions.

Compression ignition engine emissions differ from those of spark ignition engines due to the different method employed to initiate combustion. Compression ignition requires combustion of fuel droplets in a very lean air/fuel mixture. The combustion process leaves tiny particles of carbon behind and leads to significantly higher particulate emissions than are present in gasoline engines. Due to the lean operation the CO and gaseous hydrocarbon emissions are significantly lower than the gasoline engine. However, significant quantities of unburned hydrocarbon are adsorbed on the carbon particulate. These hydrocarbons are referred to as SOF (soluble organic fraction). Thus, the root cause of health concerns over diesel emissions can be traced to the inhalation of these very small carbon particles containing toxic hydrocarbons deep into the lungs.

While an increase in combustion temperature can reduce particulate, this leads to an increase in NOx emission by the well-known Zeldovitch mechanism. Thus, it becomes necessary to trade off particulate and NOx emissions to meet emissions legislation.

Available evidence strongly suggests that ultra-low sulfur fuel is a significant technology enabler for catalytic treatment of diesel exhaust to control emissions. Fuel sulfur levels of below 15 ppm, likely, are required to achieve particulate levels below 0.01 g/bhp-hr. Such levels would be very compatible with catalyst combinations for exhaust treatment now emerging, which have shown capability to achieve NOx emissions around 0.5 g/bhp-hr. Furthermore, NOx trap systems are extremely sensitive to fuel sulfur and available evidence suggests that they would need sulfur levels below 10 ppm to remain active.

In the face of ever-tightening sulfur specifications in transportation fuels, sulfur removal from petroleum feedstocks and products will become increasingly important in years to come. While legislation on sulfur in diesel fuel in Europe, Japan and the U.S. has recently lowered the specification to 0.05 percent by weight (max.), indications are that future specifications may go far below the current 0.05 percent by weight level.

Conventional hydrodesulfurization (HDS) catalysts can be used to remove a major portion of the sulfur from petroleum distillates for the blending of refinery transportation fuels, but they are not efficent for removing sulfur from compounds where the sulfur atom is sterically hindered as in multi-ring aromatic sulfur compounds. This is especially true where the sulfur heteroatom is doubly hindered (e.g., 4,6-dimethyldibenzothiophene). Using conventional hydrodesulfurization catalysts at high temperatures would cause yield loss, faster catalyst coking, and product quality deterioration (e.g., color). Using high pressure requires a large capital outlay.

In order to meet stricter specifications in the future, such hindered sulfur compounds will also have to be removed from distillate feedstocks and products. There is a pressing need for economical removal of sulfur from distillates and other hydrocarbon products.

The art is replete with processes said to remove sulfur from distillate feedstocks and products. One known method involves the oxidation of petroleum fractions containing at least a major amount of material boiling above a very high-boiling hydrocarbon materials (petroleum fractrions containing at least a major amount of material boiling above about 550° F.) followed by treating the effluent containing the oxidized compounds at elevated temperatures to form hydrogen sulfide (500° F. to 1350° F.) and/or hydroprocessing to reduce the sulfur content of the hydrocarbon material. See, for example, U.S. Pat. No. 3,847,798 in the name of Jin Sun Yoo and U.S. Pat. No. 5,288,390 in the name of Vincent A. Durante. Such methods have proven to be of only limited utility since only a rather low degree of desulfurization is achieved. In addition, substantial loss of valuable products may result due to cracking and/or coke formation during the practice of these methods. Therefore, it would be advantageous to develop a process which gives an increased degree of desulfuriztion while decreasing cracking or coke formation.

Several different oxygenation methods for improving fuels have been described in the past. For example, U.S. Pat. No. 2,521,698 describes a partial oxidation of hydrocarbon fuels as improving cetane number. This patent suggests that the fuel should have a relatively low aromatic ring content and a high paraffinic content. U.S. Pat. No. 2,912,313 states that an increase in cetane number is obtained by adding both a peroxide and a dihalo compound to middle distillate fuels. U.S. Pat. No. 2,472,152 describes a method for improving the cetane number of middle distillate fractions by the oxidation of saturated cyclic hydrocarbon or naphthenic hydrocarbons in such fractions to form naphthenic peroxides. This patent suggests that the oxidation may be accelerated in the presence of an oil-soluble metal salt as an initiator, but is preferably carried out in the presence of an inorganic base. However, the naphthenic peroxides formed are deleterious gum initiators. Consequently, gum inhibitors such as phenols, cresols and cresyic acids must be added to the oxidized material to reduce or prevent gum formation. These latter compounds are toxic and carcinogenic.

U.S. Pat. No. 4,494,961 in the name of Chaya Venkat and Dennnis E. Walsh relates to improving the cetane number of raw, untreated, highly aromatic, middle distillate fractions having a low hydrogen content by contacting the fraction at a temperature of from 50° C. to 350° C. and under mild oxidizing conditions in the presence of a catalyst which is either (i) an alkaline earth metal permanganate, (ii) an oxide of a metal of Groups IB, IIB, IIIB, IVB, VB, VIB, VIIB or VIIIB of the periodic table, or a mixture of (i) and (ii). European Patent Application 0 252 606 A2 also relates to improving the cetane rating of a middle distillate fuel fraction which may be hydro-refined by contacting the fraction with oxygen or oxidant, in the presence of catalytic metals such as tin, antimony, lead, bismuth and transition metals of Groups IB, IIB, VB, VIB, VIIB and VIIIB of the periodic table, preferably as an oil-soluble metal salt. The application states that the catalyst selectively oxidizes benzylic carbon atoms in the fuel to ketones.

Recently, U.S. Pat. No. 4,723,963 in the name of William F. Taylor suggests that cetane number is improved by including at least 3 weight percent oxygenated aromatic compounds in middle distillate hydrocarbon fuel boiling in the range of 160° C. to 400° C. This patent states that the oxygenated alkylaromatics and/or oxygenated hydroaromatics are preferably oxygenated at the benzylic carbon proton.

More recently, oxidative desulfurization of middle distillates by reaction with aqueous hydrogen peroxide catalyzed by phosphotungstic acid and tri-n-octylmethylammonium chloride as phase transfer reagent followed by silica adsorption of oxidized sulfur compounds has been described by Collins et al. (Journal of Molecular Catalysis (A): Chemical 117 (1997) 397–403). Collins et al. described the oxidative desulfurization of a winter grade diesel oil which had not undergone hydrotreating. While Collins et al. suggest that the sulfur species resistant to hydrodesulfurization should be susceptible to oxidative desulfurization, the concentrations of such resistant sulfur components in hydrodesulfurized diesel may already be relatively low compared with the diesel oils treated by Collins et al.

U.S. Pat. No. 5,814,109 in the name of Bruce R. Cook, Paul J. Berlowitz and Robert J. Wittenbrink relates to producing Diesel fuel additive, especially via a Fischer-Tropsch hydrocarbon synthesis process, preferably a non-shifting process. In producing the additive, an essentially sulfur free product of these Fischer-Tropsch processes is separated into a high-boiling fraction and a low-boiling fraction, e.g., a fraction boiling below 700° F. The high-boiling of the Fischer-Tropsch reaction product is hydroisomerizied at conditions said to be sufficient to convert the high-boiling fraction to a mixture of paraffins and isoparaffins boiling below 700° F. This mixture is blended with the low-boiling of the Fischer-Tropsch reaction product to recover the diesel additive said to be useful for improving the cetane number or lubricity, or both the cetane number and lubricity, of a mid-distillate, Diesel fuel.

U.S. Pat. No. 6,087,544 in the name of Robert J. Wittenbrink, Darryl P. Klein, Michele S Touvelle, Michel Daage and Paul J. Berlowitz relates to processing a distillate feedstream to produce distillate fuels having a level of sulfur below the distillate feedstream. Such fuels are produced by fractionating a distillate feedstream into a light fraction, which contains only from about 50 to 100 ppm of sulfur, and a heavy fraction. The light fraction is hydrotreated to remove substantially all of the sulfur therein. The desulfurized light fraction, is then blended with one half of the heavy fraction to product a low sulfur distillate fuel, for example 85 percent by weight of desulfurized light fraction and 15 percent by weight of untreated heavy fraction reduced the level of sulfur from 663 ppm to 310 ppm. However, to obtain this low sulfur level only about 85 percent of the distillate feedstream is recovered as a low sulfur distillate fuel product.

There is, therefore, a present need for catalytic processes to prepare oxygenated aromatic compounds in middle distillate hydrocarbon fuel, particularly processes, which do not have the above disadvantages. An improved process should be carried out advantageously in the liquid phase using a suitable oxygenation-promoting catalyst system, preferably an oxygenation catalyst capable of enhancing the incorporation of oxygen into a mixture of organic compounds and/or assisting by oxidation removal of sulfur or nitrogen from a mixture of organic compounds suitable as blending components for refinery transportation fuels liquid at ambient conditions.

This invention is directed to overcoming the problems set forth above in order to provide components for refinery blending of transportation fuels friendly to the environment.

SUMMARY OF THE INVENTION

Economical processes are disclosed for production of components for refinery blending of transportation fuels by selective oxidation of a petroleum distillate whereby the incorporation of oxygen into hydrocarbon compounds, sulfur-containing organic compounds, and/or nitrogen-containing organic compounds assists by oxidation removal of sulfur and/or nitrogen from components for refinery blending of transportation fuels which are friendly to the environment. This invention contemplates the treatment of various type hydrocarbon materials, especially hydrocarbon oils of petroleum origin which contain sulfur. In general, the sulfur contents of the oils are in excess of 1 percent.

For the purpose of the present invention, the term "oxidation" is defined as any means by which one or more sulfur-containing organic compound and/or nitrogen-containing organic compound is oxidized, e.g., the sulfur atom of a sulfur-containing organic molecule is oxidized to a sulfoxide and/or sulfone.

In one aspect, this invention provides a process for the production of refinery transportation fuel or blending components for refinery transportation fuel, which includes: providing oxidation feedstock comprising a mixture of hydrocarbons, sulfur-containing and nitrogen-containing organic compounds, the mixture having a gravity ranging from about 10° API to about 100° API; contacting the oxidation feedstock with an immiscible phase comprising at least one organic peracid or precursors of organic peracid in a liquid phase reaction mixture maintained substantially free of catalytic active metals and/or active metal-containing compounds and under conditions suitable for the oxidation of one or more of the sulfur-containing and/or nitrogen-containing organic compounds; separating at least a portion of the immiscible peracid-containing phase from the reaction mixture; and recovering a product comprising a mixture of organic compounds containing less sulfur and/or less nitrogen than the oxidation feedstock from the reaction mixture. Conditions of oxidation include temperatures in a range upward from about 25° C. to about 250° C. and sufficient pressure to maintain the reaction mixture substantially in a liquid phase.

In a further aspect of this invention, at least a portion of the immiscible peracid-containing phase separated from the oxygenated phase of the reaction mixture is recycled to the reaction mixture.

This invention is particularly useful towards sulfur-containing organic compounds in the oxidation feedstock which includes compounds in which the sulfur atom is sterically hindered, as for example in multi-ring aromatic sulfur compounds. Typically, the sulfur-containing organic compounds include at least sulfides, heteroaromatic sulfides, and/or compounds selected from the group consisting of substituted benzothiophenes and dibenzothiophenes.

Generally, for use in this invention, the immiscible phase is formed by admixing a source of hydrogen peroxide and/or alkylhydroperoxide, a source of an aliphatic monocarboxylic acid containing 1 to about 8 carbon atoms per molecule, and water. The ratio of acid to peroxide is generally in a range upward from about 1, preferably in a range from about 1 to about 10.

Advantageously, the immiscible peracid-containing phase is an aqueous liquid formed by admixing, water, a source of acetic acid, and a source of hydrogen peroxide in amounts which provide at least one mole acetic acid for each mole of hydrogen peroxide. Preferably the ratio of acetic acid to hydrogen peroxide is in a range from about 1 to about 10, more preferably in a range from about 1.5 to about 5. Conditions of oxidation include temperatures in a range upward from about 25° C. to about 250° C. and sufficient pressure to maintain the reaction mixture substantially in a liquid phase.

In one aspect of this invention all or at least a portion of the oxidation feedstock is a product of a hydrotreating process for petroleum distillate consisting essentially of material boiling between about 50° C. and about 425° C. which hydrotreating process includes reacting the petroleum distillate with a source of hydrogen at hydrogenation conditions in the presence of a hydrogenation catalyst to assist by hydrogenation removal of sulfur and/or nitrogen from the hydrotreated petroleum distillate. Generally, useful hydrogenation catalysts comprise at least one active metal, selected from the group consisting of the d-transition elements in the Periodic Table, each incorporated onto an inert support in an amount of from about 0.1 percent to about 30 percent by weight of the total catalyst. Suitable active metals include the d-transition elements in the Periodic Table elements having atomic number in from 21 to 30, 39 to 48, and 72 to 78.

Hydrogenation catalysts beneficially contain a combination of metals. Preferred are hydrogenation catalysts containing at least two metals selected from the group consisting of cobalt, nickel, molybdenum and tungsten. More preferably, co-metals are cobalt and molybdenum or nickel and molybdenum. Advantageously, the hydrogenation catalyst comprises at least two active metals, each incorporated onto a metal oxide support, such as alumina in an amount of from about 0.1 percent to about 20 percent by weight of the total catalyst.

In one aspect, this invention provides for the production of refinery transportation fuel or blending components for refinery transportation fuel comprising the following steps: hydrotreating a petroleum distillate consisting essentially of material boiling between about 200° C. and about 425° C. by a process which includes reacting the petroleum distillate with a source of hydrogen at hydrogenation conditions in the presence of a hydrogenation catalyst to assist by hydrogenation removal of sulfur and/or nitrogen from the hydrotreated petroleum distillate; fractionating the hydrotreated petroleum distillate by distillation to provide at least one low-boiling blending component consisting of a sulfur-lean, mono-aromatic-rich fraction, and a high-boiling feedstock consisting of a sulfur-rich, mono-aromatic-lean fraction; contacting at least a portion of the high-boiling feedstock with an immiscible phase comprising at least one organic peracid or precursors of organic peracid, in a liquid reaction mixture maintained substantially free of catalytic active metals and/or active metal-containing compounds and under conditions suitable for oxidation of one or more of the sulfur-containing and/or nitrogen-containing organic compounds; separating at least a portion of the immiscible peracid-containing phase from the reaction mixture to recover an essentially organic phase from the reaction mixture; and treating at least a portion of the recovered organic phase with a solid sorbent, an ion exchange resin, and/or a suitable immiscible liquid containing a solvent or a soluble basic chemical compound, to obtain a product containing less sulfur and/or less nitrogen than the feedstock.

Where the oxidation feedstock is a high-boiling distillate fraction derived from hydrogenation of a refinery stream, the refinery stream consists essentially of material boiling between about 200° C. and about 425° C. Preferably the refinery stream consisting essentially of material boiling between about 250° C. and about 400° C., and more preferably boiling between about 275° C. and about 375° C.

Preferably, the immiscible peracid-containing phase is an aqueous liquid formed by admixing, water, a source of acetic acid, and a source of hydrogen peroxide in amounts which provide at least one mole acetic acid for each mole of and hydrogen peroxide. Beneficially, at least a portion of the separated peracid-containing phase is recycled to the reaction mixture.

In another aspect of this invention the treating of recovered organic phase includes use of at least one immiscible liquid comprising an aqueous solution of a soluble basic chemical compound selected from the group consisting of sodium, potassium, barium, calcium and magnesium in the form of hydroxide, carbonate or bicarbonate. Particularly useful are aqueous solution of sodium hydroxide or bicarbonate.

In one aspect of this invention the treating of the recovered organic phase includes use of at least one solid sorbent comprising alumina.

In another aspect of this invention the treating of recovered organic phase includes use of at least one immiscible liquid comprising a solvent having a dielectric constant suitable to selectively extract oxidized sulfur-containing and/or nitrogen-containing organic compounds. Advantageously, the solvent has a dielectric constant in a range from about 24 to about 80. Useful solvents include mono- and dihydric alcohols of 2 to about 6 carbon atoms, preferably methanol, ethanol, propanol, ethylene glycol, propylene glycol, butylene glycol and aqueous solutions thereof. Particularly useful are immiscible liquids wherein the solvent comprises a compound that is selected from the group consisting of water, methanol, ethanol and mixtures thereof.

In yet another aspect of this invention the soluble basic chemical compound is sodium bicarbonate, and the treating of the organic phase further comprises subsequent use of at least one other immiscible liquid comprising methanol.

In other aspects of this invention, continuous processes are provided wherein the step of contacting the oxidation feedstock and immiscible phase is carried out continuously with counter-current, cross-current, or co-current flow of the two phases.

In one aspect of this invention, the recovered organic phase of the reaction mixture is contacted sequentially with (i) an ion exchange resin and (ii) a heterogeneous sorbent to obtain a product having a suitable total acid number.

For a more complete understanding of the present invention, reference should now be made to the embodiments illustrated in greater detail in the accompanying drawing and described below by way of examples of the invention.

BRIEF DESCRIPTION OF THE DRAWING

The drawing is a schematic flow diagram depicting a preferred aspect of the present invention for continuous production of components for blending of transportation fuels which are liquid at ambient conditions. Elements of the invention in this schematic flow diagram include hydrotreating a petroleum distillate with a source of dihydrogen (molecular hydrogen), and fractionating the hydrotreated petroleum to provide a low-boiling blending component consisting of a sulfur-lean, mono-aromatic-rich fraction, and a high-boiling oxidation feedstock consisting of a sulfur-rich, mono-aromatic-lean fraction. This high-boiling oxidation feedstock is contacted with an immiscible phase comprising at least one organic peracid or precursors of organic peracid, in a liquid reaction mixture maintained substantially free of catalytic active metals and/or active metal-containing compounds and under conditions suitable for the oxidation of one or more of the sulfur-containing and/or nitrogen-containing organic compounds. Thereafter, the immiscible phases are separated by gravity to recover a portion of the acid-containing phase for recycle. The other portion of the reaction mixture is contacted with a solid sorbent and/or an ion exchange resin to recover a mixture of organic products containing less sulfur and/or less nitrogen than the oxidation feedstock.

GENERAL DESCRIPTION

Suitable feedstocks generally comprise most refinery streams consisting substantially of hydrocarbon compounds which are liquid at ambient conditions. Suitable oxidation feedstock generally has an API gravity ranging from about 10° API to about 100° API, preferably from about 20° API to about 80 or 100° API, and more preferably from about 30° API to about 70 or 100° API for best results. These streams include, but are not limited to, fluid catalytic process naphtha, fluid or delayed process naphtha, light virgin naphtha, hydrocracker naphtha, hydrotreating process naphthas, alkylate, isomerate, catalytic reformate, and aromatic derivatives of these streams such benzene, toluene, xylene, and combinations thereof. Catalytic reformate and catalytic cracking process naphthas can often be split into narrower boiling range streams such as light and heavy catalytic naphthas and light and heavy catalytic reformate, which can be specifically customized for use as a feedstock in accordance with the present invention. The preferred streams are light virgin naphtha, catalytic cracking naphthas including light and heavy catalytic cracking unit naphtha, catalytic reformate including light and heavy catalytic reformate and derivatives of such refinery hydrocarbon streams.

Suitable oxidation feedstocks generally include refinery distillate steams boiling at a temperature range from about 50° C. to about 425° C., preferably 150° C. to about 400° C., and more preferably between about 175° C. and about 375° C. at atmospheric pressure for best results. These streams include, but are not limited to, virgin light middle distillate, virgin heavy middle distillate, fluid catalytic cracking process light catalytic cycle oil, coker still distillate, hydrocracker distillate, and the collective and individually hydrotreated embodiments of these streams. The preferred streams are the collective and individually hydrotreated embodiments of fluid catalytic cracking process light catalytic cycle oil, coker still distillate, and hydrocracker distillate.

It is also anticipated that one or more of the above distillate steams can be combined for use as oxidation feedstock. In many cases performance of the refinery transportation fuel or blending components for refinery transportation fuel obtained from the various alternative feedstocks may be comparable. In these cases, logistics such as the volume availability of a stream, location of the nearest connection and short term economics may be determinative as to what stream is utilized.

Typically, sulfur compounds in petroleum fractions are relatively non-polar, heteroaromatic sulfides such as substituted benzothiophenes and dibenzothiophenes. At first blush it might appear that heteroaromatic sulfur compounds could be selectively extracted based on some characteristic attributed only to these heteroaromatics. Even though the sulfur atom in these compounds has two, non-bonding pairs of electrons which would classify them as a Lewis base, this characteristic is still not sufficient for them to be extracted by a Lewis acid. In other words, selective extraction of heteroaromatic sulfur compounds to achieve lower levels of sulfur requires greater difference in polarity between the sulfides and the hydrocarbons.

By means of liquid phase oxidation according to this invention it is possible to selectively convert these sulfides into, more polar, Lewis basic, oxygenated sulfur compounds such as sulfoxides and sulfones. A compound such as dimethylsulfide is a very non-polar molecule, whereas when oxidized, the molecule is very polar. Accordingly, by selectively oxidizing heteroaromatic sulfides such as benzo- and dibenzothiophene found in a refinery streams, processes of the invention are able to selectively bring about a higher polarity characteristic to these heteroaromatic compounds. Where the polarity of these unwanted sulfur compounds is increased by means of liquid phase oxidation according to this invention, they can be selectively extracted by a polar solvent and/or a Lewis acid sorbent while the bulk of the hydrocarbon stream is unaffected.

Other compounds which also have non-bonding pairs of electrons include amines. Heteroaromatic amines are also found in the same stream that the above sulfides are found. Amines are more basic than sulfides. The lone pair of electrons functions as a Bronsted-Lowry base (proton acceptor) as well as a Lewis base (electron-donor). This pair of electrons on the atom makes it vulnerable to oxidation in manners similar to sulfides.

As disclosed herein the oxidation feedstock is contacted with an immiscible phase comprising at least one organic peracid which contains the —OOH substructure or precursors of organic peracid, and the liquid reaction mixture is maintained substantially free of catalytic active metals and/or active metal-containing compounds and under conditions suitable for oxidation of one or more of the sulfur-containing and/or nitrogen-containing organic compounds. Organic peracids for use in this invention are preferably made from a combination of hydrogen peroxide and a carboxylic acid.

With respect to the organic peracids the carbonyl carbon is attached to hydrogen or a hydrocarbon radical. In general such hydrocarbon radical contains from 1 to about 12 carbon atoms, preferably from about 1 to about 8 carbon atoms. More preferably, the organic peracid is selected from the group consisting of performic acid, peracetic acid, trichloroacetic acid, perbenzoic acid and perphpthalic acid or precursors thereof. For best results, processes of the present invention employ peracetic acid or precursors of peracetic acid.

Broadly, the appropriate amount of organic peracid used herein is the stoichiometric amount necessary for oxidation of one or more of the sulfur-containing and/or nitrogen-containing organic compounds in the oxidation feedstock and is readily determined by direct experimentation with a selected feedstock. With a higher concentration of organic peracid, the selectivity generally tends to favor the more highly oxidized sulfone which beneficially is even more polar than the sulfoxide.

Applicants believe the oxidation reaction involves rapid reaction of organic peracid with the divalent sulfur atom by a concerted, non-radical mechanism whereby an oxygen atom is actually donated to the sulfur atom. As stated previously, in the presence of more peracid, the sulfoxide is further converted to the sulfone, presumably by the same mechanism. Similarly, it is expected that the nitrogen atom of an amine is oxidized in the same manner by hydroperoxy compounds.

The statement that oxidation according to the invention in the liquid reaction mixture comprises a step whereby an oxygen atom is donated to the divalent sulfur atom is not to be taken to imply that processes according to the invention actually proceeds via such a reaction mechanism.

By contacting the oxidation feedstock with a peracid-containing immiscible phase in a liquid reaction mixture maintained substantially free of catalytic active metals and/or active metal-containing compounds, the tightly substituted sulfides are oxidized into their corresponding sulfoxides and sulfones with negligible if any co-oxidation of mononuclear aromatics. These oxidation products due to their high polarity, can be readily removed by separation techniques such as sorption, extraction and/or distillation. The high selectivity of the oxidants, coupled with the small amount of tightly substituted sulfides in hydrotreated streams, makes the instant invention a particularly effective deep desulfurization means with minimum yield loss. The yield loss corresponds to the amount of tightly substituted sulfides oxidized. Since the amount of tightly substituted sulfides present in a hydrotreated crude is rather small, the yield loss is correspondingly small.

Broadly, the liquid phase oxidation reactions are rather mild and can even be carried out at temperatures as low as room temperature. More particularly, the liquid phase oxidation will be conducted under any conditions capable of converting the tightly substituted sulfides into their corresponding sulfoxides and sulfones at reasonable rates.

In accordance with this invention conditions of the liquid mixture suitable for oxidation during the contacting, the oxidation feedstock with the organic peracid-containing immiscible phase include any pressure at which the desired oxidation reactions proceed. Typically, temperatures upward from about 10° C. are suitable, and sufficient pressure to maintain the reaction mixture substantially in a liquid phase. Preferred temperatures are between about 25° C. and about 250° C., with temperatures between about 50° and about 150° C. being more preferred. Most preferred temperatures are between about 80° C. and about 125° C.

Integrated processes of the invention can include one or more selective separation steps using solid sorbents capable of removing sulfoxides and sulfones. Non-limiting examples of such sorbents, commonly known to the skilled artisan, include activated carbons, activated bauxite, activated clay, activated coke, alumina, and silica gel. The oxidized sulfur containing hydrocarbon material is contacted with solid sorbent for a time sufficient to reduce the sulfur content of the hydrocarbon phase.

Integrated processes of the invention can include one or more selective separation steps using an immiscible liquid containing a soluble basic chemical compound. The oxidized sulfur containing hydrocarbon material is contacted with the solution of chemical base for a time sufficient to reduce the acid content of the hydrocarbon phase, generally from about 1 second to about 24 hours, preferably from 1 minute to 60 minutes. The reaction temperature is generally from about 10° C. to about 230° C., preferably from about 40° C. to about 150° C.

Generally, the suitable basic compounds include ammonia or any hydroxide, carbonate or bicarbonate of an element selected from Group I, II, and/or III of the periodic table, although calcined dolomitic materials and alkalized aluminas can be used. In addition, mixtures of different bases can be utilized. Preferably the basic compound is a hydroxide, carbonate or bicarbonate of an element selected from Group I and/or II element. More preferably, the basic compound is selected from the group consisting of sodium, potassium, barium, calcium and magnesium hydroxide, carbonate or bicarbonate. For best results processes of the present invention employ an aqueous solvent containing an alkali metal hydroxide, preferably selected from the group consisting of sodium, potassium, barium, calcium and magnesium hydroxide.

In carrying out a sulfur separation step according to this invention, pressures of near atmospheric and higher are suitable. While pressures up to 100 atmosphere can be used, pressures are generally in a range from about 15 psi to about 500 psi, preferably from about 25 psi to about 400 psi.

Processes of the present invention advantageously include catalytic hydrodesulfurization of the oxidation feedstock to form hydrogen sulfide which may be separated as a gas from the liquid feedstock, collected on a solid sorbent, and/or by washing with an aqueous liquid. Where the oxidation feedstock is a product of a process for hydrogenation of a petroleum distillate to facilitate removal of sulfur and/or nitrogen from the hydrotreated petroleum distillate, the amount of peracid necessary for the instant invention is the stoichiometric amount necessary to oxidize the tightly substituted sulfides contained in the hydrotreated stream being treated in accordance herewith. Preferably an amount which will oxidize all of the tightly substituted sulfides will be used.

Useful distillate fractions for hydrogenation in the present invention consists essentially of any one, several, or all refinery streams boiling in a range from about 50° C. to about 425° C., preferably 150° C. to about 400° C., and more preferably between about 175° C. and about 375° C. at atmospheric pressure. The lighter hydrocarbon components in the distillate product are generally more profitably recovered to gasoline and the presence of these lower boiling materials in distillate fuels is often constrained by distillate fuel flash point specifications. Heavier hydrocarbon components boiling above 400° C. are generally more profitably processed as fluid catalytic cracker feed and converted to gasoline. The presence of heavy hydrocarbon components in distillate fuels is further constrained by distillate fuel end point specifications.

The distillate fractions for hydrogenation in the present invention can comprise high and low sulfur virgin distillates derived from high- and low-sulfur crudes, coker distillates, catalytic cracker light and heavy catalytic cycle oils, and distillate boiling range products from hydrocracker and resid hydrotreater facilities. Generally, coker distillate and the light and heavy catalytic cycle oils are the most highly aromatic feedstock components, ranging as high as 80 percent by weight. The majority of coker distillate and cycle oil aromatics are present as mono-aromatics and di-aromatics with a smaller portion present as tri-aromatics. Virgin stocks such as high and low sulfur virgin distillates are lower in aromatics content ranging as high as 20 percent by weight aromatics. Generally, the aromatics content of a combined hydrogenation facility feedstock will range from about 5 percent by weight to about 80 percent by weight, more typically from about 10 percent by weight to about 70 percent by weight, and most typically from about 20 percent by weight to about 60 percent by weight.

Sulfur concentration in distillate fractions for hydrogenation in the present invention is generally a function of the high and low sulfur crude mix, the hydrogenation capacity of a refinery per barrel of crude capacity, and the alternative dispositions of distillate hydrogenation feedstock components. The higher sulfur distillate feedstock components are generally virgin distillates derived from high sulfur crude, coker distillates, and catalytic cycle oils from fluid catalytic cracking units processing relatively higher sulfur feedstocks. These distillate feedstock components can range as high as 2 percent by weight elemental sulfur but generally range from about 0.1 percent by weight to about 0.9 percent by weight elemental sulfur.

Nitrogen content of distillate fractions for hydrogenation in the present invention is also generally a function of the nitrogen content of the crude oil, the hydrogenation capacity of a refinery per barrel of crude capacity, and the alternative dispositions of distillate hydrogenation feedstock components. The higher nitrogen distillate feedstocks are generally coker distillate and the catalytic cycle oils. These distillate feedstock components can have total nitrogen concentrations ranging as high as 2000 ppm, but generally range from about 5 ppm to about 900 ppm.

The catalytic hydrogenation process may be carried out under relatively mild conditions in a fixed, moving fluidized or ebullient bed of catalyst. Preferably a fixed bed of catalyst is used under conditions such that relatively long periods elapse before regeneration becomes necessary, for example an average reaction zone temperature of from about 200° C. to about 450° C., preferably from about 250° C. to about 400° C., and most preferably from about 275° C. to about 350° C. for best results, and at a pressure within the range of from about 6 to about 160 atmospheres.

A particularly preferred pressure range within which the hydrogenation provides extremely good sulfur removal while minimizing the amount of pressure and hydrogen required for the hydrodesulfurization step are pressures within the range of 20 to 60 atmospheres, more preferably from about 25 to 40 atmospheres.

According the present invention, suitable distillate fractions are preferably hydrodesulfurized before being selectively oxidized, and more preferably using a facility capable of providing effluents of at least one low-boiling fraction and one high-boiling fraction.

Generally, the hydrogenation process useful in the present invention begins with a distillate fraction preheating step. The distillate fraction is preheated in feed/effluent heat exchangers prior to entering a furnace for final preheating to a targeted reaction zone inlet temperature. The distillate fraction can be contacted with a hydrogen stream prior to, during, and/or after preheating.

The hydrogen stream can be pure hydrogen or can be in admixture with diluents such as hydrocarbon, carbon monoxide, carbon dioxide, nitrogen, water, sulfur compounds, and the like. The hydrogen stream purity should be at least about 50 percent by volume hydrogen, preferably at least about 65 percent by volume hydrogen, and more preferably at least about 75 percent by volume hydrogen for best results. Hydrogen can be supplied from a hydrogen plant, a catalytic reforming facility or other hydrogen producing process.

The reaction zone can consist of one or more fixed bed reactors containing the same or different catalysts. A fixed bed reactor can also comprise a plurality of catalyst beds. The plurality of catalyst beds in a single fixed bed reactor can also comprise the same or different catalysts.

Since the hydrogenation reaction is generally exothermic, interstage cooling, consisting of heat transfer devices between fixed bed reactors or between catalyst beds in the same reactor shell, can be employed. At least a portion of the heat generated from the hydrogenation process can often be profitably recovered for use in the hydrogenation process. Where this heat recovery option is not available, cooling may be performed through cooling utilities such as cooling water or air, or through use of a hydrogen quench stream injected directly into the reactors. Two-stage processes can provide reduced temperature exotherm per reactor shell and provide better hydrogenation reactor temperature control.

The reaction zone effluent is generally cooled and the effluent stream is directed to a separator device to remove the hydrogen. Some of the recovered hydrogen can be recycled back to the process while some of the hydrogen can be purged to external systems such as plant or refinery fuel. The hydrogen purge rate is often controlled to maintain a minimum hydrogen purity and remove hydrogen sulfide. Recycled hydrogen is generally compressed, supplemented with "make-up" hydrogen, and injected into the process for further hydrogenation.

Liquid effluent of the separator device can be processed in a stripper device where light hydrocarbons can be removed and directed to more appropriate hydrocarbon pools. Preferably the separator and/or stripper device includes means capable of providing effluents of at least one low-boiling liquid fraction and one high-boiling liquid fraction. Liquid effluent and/or one or more liquid fraction thereof is subsequently treated to incorporate oxygen into the liquid organic compounds therein and/or assist by oxidation removal of sulfur or nitrogen from the liquid products. Liquid products are then generally conveyed to blending facilities for production of finished distillate products.

Operating conditions to be used in the hydrogenation process include an average reaction zone temperature of from about 200° C. to about 450° C., preferably from about 250° C. to about 400° C., and most preferably from about 275° C. to about 350° C. for best results.

The hydrogenation process typically operates at reaction zone pressures ranging from about 400 psig to about 2000 psig, more preferably from about 500 psig to about 1500 psig, and most preferably from about 600 psig to about 1200 psig for best results. Hydrogen circulation rates generally range from about 500 SCF/Bbl to about 20,000 SCF/Bbl, preferably from about 2,000 SCF/Bbl to about 15,000 SCF/Bbl, and most preferably from about 3,000 to about 13,000 SCF/Bbl for best results. Reaction pressures and hydrogen circulation rates below these ranges can result in higher catalyst deactivation rates resulting in less effective desulfurization, denitrogenation, and dearomatization. Excessively high reaction pressures increase energy and equipment costs and provide diminishing marginal benefits.

The hydrogenation process typically operates at a liquid hourly space velocity of from about 0.2 hr−1 to about 10.0 $hr^{-1}$, preferably from about 0.5 $hr^{-1}$ to about 3.0 $hr^{-1}$, and most preferably from about 1.0 $hr^{-1}$ to about 2.0 $hr^{-1}$ for best results. Excessively high space velocities will result in reduced overall hydrogenation.

Useful catalyst for the hydrotreating comprise a component capable to enhance the incorporation of hydrogen into a mixture of organic compounds to thereby form at least hydrogen sulfide, and a catalyst support component. The catalyst support component typically comprises a refractory inorganic oxide such as silica, alumina, or silica-alumina. Refractory inorganic oxides, suitable for use in the present invention, preferably have a pore diameter ranging from about 50 to about 200 Angstroms, and more preferably from about 80 to about 150 Angstroms for best results. Advantageously, the catalyst support component comprises a refractory inorganic oxide such as alumina.

Further reduction of such heteroaromatic sulfides from a distillate petroleum fraction by hydrotreating would require that the stream be subjected to very severe catalytic hydrogenation in order to convert these compounds into hydrocarbons and hydrogen sulfide ($H_2S$). Typically, the larger any hydrocarbon moiety is, the more difficult it is to hydrogenate the sulfide. Therefore, the residual organo-sulfur compounds remaining after a hydrotreatment are the most tightly substituted sulfides.

Subsequent to hydrotreating by catalytic hydrogenation as disclosed herein, further selective removal of sulfur or nitrogen containing organic compounds can be accomplished by the incorporation of oxygen into such compounds thereby assisting in selective removal of sulfur or nitrogen from oxidation feedstocks.

DESCRIPTION OF THE PREFERRED EMBODIMENTS

In order to better communicate the present invention, still another preferred aspect of the invention is depicted schematically in the drawing. Referring now to the schematic flow diagram, a substantially liquid stream of middle distillates from a refinery source 12 is charged through conduit 14 into catalytic reactor 20. A gaseous mixture containing dihydrogen (molecular hydrogen) is supplied to catalytic reactor 20 from storage or a refinery source 16 through conduit 18. Catalytic reactor 20 contains one or more fixed bed of the same or different catalyst which have a hydrogenation-promoting action for desulfurization, denitrogenation, and dearomatization of middle distillates. The reactor may be operated in up-flow, down-flow, or counter-current flow of the liquid and gases through the bed.

One or more beds of catalyst and subsequent separation and distillation operate together as an integrated hydrotreating and fractionation system. This system separates unreacted dihydrogen, hydrogen sulfide and other non-condensable products of hydrogenation from the effluent stream and the resulting liquid mixture of condensable compounds is fractionated into a low-boiling fraction containing a minor amount of remaining sulfur and a high-boiling fraction containing a major amount of remaining sulfur.

Mixed effluents from catalytic reactor 20 are transferred into separation drum 24 through conduit 22. Unreacted dihydrogen, hydrogen sulfide and other non-condensed compounds flow from separation drum 24 through conduit 28 to hydrogen recovery (not shown). Advantageously, all or a portion of the unreacted hydrogen may be recycled to catalytic reactor 20, provided at least a portion of the hydrogen sulfide has been separated therefrom.

Hydrogenated liquids flow from separation drum 24 into distillation column 30 through conduit 26. Gases and condensable vapors from the top of column 30 are transferred through overhead cooler 40, by means of conduits 34 and 42, and into overhead drum 46. Separated gases and non-condensed compounds flow from overhead drum 46 to disposal or further recovery (not shown) through conduit 49. A portion of the condensed organic compounds suitable for reflux is returned from overhead drum 46 to column 30 through conduit 48. Other portions of the condensate are beneficially recycled from overhead drum 46 to separation drum 24 and/or transferred to other refinery uses (not shown).

The low-boiling fraction having the minor amount of sulfur-containing organic compounds is withdrawn from near the top of column 30 and transferred to fuel blending facility 90 through conduit 32. It should be apparent that this low-boiling fraction from the catalytic hydrogenation is a valuable product in itself.

Beneficially, all or a portion of the low-boiling fraction in substantially liquid form is diverted through conduit 32*a* and into an optional oxygenation process unit 110 for catalytic oxidation in the liquid phase with a gaseous source of dioxygen, such as air or oxygen enriched air. For the purpose of the present invention, the term "oxygenation" is defined as any means by which one or more atoms of oxygen is added to a hydrocarbon molecule. Particularly suitable catalytic oxygenation processes are disclosed in commonly assigned U.S. patent application Ser. No. 09/779,283 and U.S. patent application Ser. No. 09/779,286.

A stream containing oxygenated organic compounds is subsequently separated to recover, for example, a fuel or a blending component of fuel and transferred to fuel blending facility 90 through conduit 32*b*. The stream can alternatively be utilized as a source of feed stock for chemical manufacturing.

A portion of the high-boiling liquid at the bottom of column 30 is transferred to reboiler 36 through conduit 35, and a stream of vapor from reboiler 36 is returned to distillation column 30 through conduit 35.

From the bottom of column 30 another portion of the high-boiling liquid fraction having the major amount of the sulfur-containing organic compounds is supplied as an oxidation feedstock to oxidation reactor 60 through conduit 38.

An immiscible phase including at least peracetic acid and/or other organic peracids, is supplied to oxidation reactor 60 through manifold 50. The liquid reaction mixture in oxidation reactor 60 is maintained substantially free of catalytic active metals and/or active metal-containing compounds and under conditions suitable for oxidation of one or more of the sulfur-containing and/or nitrogen-containing organic compounds. Suitably the oxidation reactor 60 is maintained at temperatures in a range of from about 80° C. to about 125° C., and at pressures in a range from about 15 psi to about 400 psi, preferably from about 15 psi to about 150 psi.

Liquid reaction mixture from reactor 60 is supplied to drum 64 through conduit 62. At least a portion of the immiscible phase is separated by gravity from the other phase of the reaction mixture. While a portion of the immiscible phase may be returned directly to reactor 60, according to the embodiment illustrated in the schematic flow diagram the phase is withdrawn from drum 64 through conduit 66 and transferred into separation unit 80.

The immiscible phase contains water of reaction, carboxylic acids, and oxidized sulfur-containing and/or nitrogen-containing organic compounds which are now soluble in the immiscible phase. Acetic acid and excess water are separated from high-boiling sulfur-containing and/or nitrogen-containing organic compounds as by distillation. Recovered acetic acid is returned to oxidation reactor 60 through conduit 82 and manifold 50. Hydrogen peroxide is supplied to manifold 50 from storage 52 through conduit 54. As needed, makeup acetic acid solution is supplied to manifold 50 from storage 56, or another source of aqueous acetic acid, through conduit 58. Excess water is withdrawn from separation unit 80 and transferred through conduit 86 to disposal (not shown). At least a portion of the oxidized high-boiling sulfur-containing and/or nitrogen-containing organic compounds are transferred through conduit 84 and into catalytic reactor 20.

The separated phase of the reaction mixture from drum 64 is supplied to vessel 70 through conduit 68. Vessel 70 contains a bed of solid sorbent which exhibits the ability to retain acidic and/or other polar compounds, to obtain product containing less sulfur and/or less nitrogen than the feedstock to the oxidation. Product is transferred from vessel 70 to fuel blending facility 90 through conduit 72. Preferably, in this embodiment a system of two or more reactors containing solid sorbent, configured for parallel flow, is used to allow continuous operation while one bed of sorbent is regenerated or replaced.

In view of the features and advantages of processes in accordance with this invention using selected organic peracids in a liquid phase reaction mixture maintained substantially free of catalytic active metals and/or active metal-containing compounds to preferentially oxidize compounds in which a sulfur atom is sterically hindered rather than aromatic hydrocarbons, as compared to known desulfurization systems previously used, the following examples are given. The following examples are illustrative and are not meant to be limiting.

General

Oxygenation of a hydrocarbon product was determined by the difference between the high precision carbon and hydrogen analysis of the feed and product.

Oxygenation, percent,=(percent C+percent H) analysis of feed−(percent C+percent H) analysis of oxygenated product

EXAMPLE 1

In this example a refinery distillate containing sulfur at a level of about 500 ppm was hydrotreated under conditions suitable to produce hydrodesulfurized distillate containing sulfur at a level of about 130 ppm, which was identified as hydrotreated distillate 150. Hydrotreated distillate 150 was cut by distillation into four fractions which were collected at temperatures according to the following schedule.

| Fraction | Temperatures, ° C. |
|---|---|
| 1 | Below 260 |
| 2 | 260 to 288 |
| 3 | 288 to 316 |
| 4 | Above 316 |

Analysis of hydrotreated distillate 150 over this range of distillation cut points is shown in Table I. In accordance with this invention a fraction collected below a temperature in the range from about 260° C. to about 300° C. splits hydrotreated distillate 150 into a sulfur-lean, monoaromatic-rich fraction and a sulfur-rich, monoaromatic-lean fraction.

TABLE I

ANALYSIS OF DISTILLLATION FRACTIONS OF HYDROTREATED DISTILLATE 150

| | Fraction Number | | | | |
|---|---|---|---|---|---|
| Item | 1 | 2 | 3 | 4 | Total |
| Weight,% | 45 | 21 | 19 | 16 | 100 |
| Sulfur, ppm | 11.7 | 25 | 174 | 580 | 133 |
| Mono-Ar, % | 40.7 | 26.3 | 15.6 | 14.0 | 28.8 |
| Di-Ar,% | 0.4 | 5.0 | 5.4 | 5.6 | 3.1 |
| Tri-Ar,% | 0 | 0 | 0 | 0.8 | 0.1 |

Mono-Ar is mono-aromatics.
Di-Ar is di-aromatics.
Tn-Ar is tri-aromatics.

EXAMPLE 2

In this example a refinery distillate containing sulfur at a level of about 500 ppm was hydrotreated under conditions suitable to produce a hydrodesulfurized distillate containing sulfur at a level of about 15 ppm, which was identified as hydrotreated distillate 15.

Analysis of hydrotreated distillate 15 over the range of distillation cut points is shown in Table II. In accordance with this invention a fraction collected below a temperature in the range from about 260° C. to about 300° C. splits hydrotreated distillate 15 into a sulfur-lean, monoaromatic-rich fraction and a sulfur-rich, monoaromatic-lean fraction.

TABLE II

ANALYSIS OF DISTILLATION FRACTIONS OF HYDROTREATED DISTILLATE 15

| | Fraction Number | | | | |
|---|---|---|---|---|---|
| Item | 1 | 2 | 3 | 4 | Total |
| Weight,% | 53 | 16 | 20 | 11 | 100 |
| Sulfur, ppm | 1 | 2 | 13 | 80 | 12.3 |
| Mono-Ar, % | 35.8 | 20.9 | 14.8 | 12.0 | 5.6 |
| Di-Ar,% | 1.3 | 8.0 | 7.4 | 5.6 | 4.0 |
| Tri-Ar,% | 0 | 0 | 0 | 1.4 | 0.2 |

Mono-Ar is mono-aromatics.
Di-Ar is di-aromatics.
Tn-Ar is tri-aromatics.

EXAMPLES 3–6

Hydrotreated refinery distillate S-25 was partitioned by distillation to provide feedstock for oxidation using hydrogen peroxide and acetic acid. The fraction collected below temperatures of about 300° C. was a sulfur-lean, monoaromatic-rich fraction identified as S-25-B300. Analyses of S-25-B300 determined a sulfur content of 3 ppm, a nitrogen content of 2 ppm, and 36.2 percent mono-aromatics, 1.8 percent di-aromatics, for a total aromatics of 37.9 percent. The fraction collected above temperatures of about 300° C. was a sulfur-rich, monoaromatic-poor fraction identified as S-25-A300. Analyses of S-25-A300 determined a sulfur content of 35 ppm, a nitrogen content of 31 ppm, and aromatic content was 15.7 percent mono-aromatics, 5.8 percent di-aromatics, and 1.4 percent tri-aromatics, for a total aromatics of 22.9 percent.

Into a 250 mL, three-neck round bottom flask equipped with a reflux condenser, a mechanical agitator, a nitrogen inlet and outlet, were charged 100 g of S-25-A300. The reactor was also charged with varying amounts of glacial acetic acid, distilled and deionized water, and 30 percent aqueous hydrogen peroxide. The mixture is heated with stirring and under a slight flow of nitrogen at approximately 93° C. to 99° C. for approximately two hours. At the end of the reaction period, the agitation ceased and the contents of the flask rapidly formed into two liquid layers. A sample of the top layer (organic) was withdrawn and dehydrated with anhydrous sodium sulfate. Contents of the flask was stirred and permitted to cool to ambient temperature before approximately 0.1 g of manganese dioxide is added to decompose any residual hydrogen peroxide. At this point, the mixture was stirred for an additional 10 minutes before the entire reactor content was collected.

TABLE III

EXPERIMENTAL PARAMETERS AND ANALYTICAL RESULTS FOR OXIDATIONS OF LS-25-A300

| EXAMPLE | 3 | 4 | 5 | 6 |
|---|---|---|---|---|
| $H_2O_2$, mL | 34 | 34 | 34 | 34 |
| HOAc, mL | 0 | 25 | 50 | 75 |
| $H_2O$, mL | 100 | 75 | 50 | 25 |

TABLE III-continued

EXPERIMENTAL PARAMETERS AND ANALYTICAL RESULTS FOR OXIDATIONS OF LS-25-A300

| EXAMPLE | 3 | 4 | 5 | 6 |
|---|---|---|---|---|
| Sulfur Aq, ppm | <2 | <2 | 13 | 14 |
| Sulfur Org, ppm | 33 | 30 | 21 | 18 |

$H_2O_2$ is 30 percent hydrogen peroxide. HOAc is glacial acetic acid. $H_2O$ is distilled water.

Table III gives variables and analytical data which demonstrate that increasing concentration of acetic acid increases concentration of total sulfur in the aqueous layer. Increasing the level of acetic acid caused sulfur in the organic layer to decrease from 35 ppm. These data clearly indicate that an essential element of the present of invention is the use of organic peracids where the carbonyl carbon is attached to hydrogen or a hydrocarbon radical. In general such hydrocarbon radical contains from 1 to about 12 carbon atoms, preferably from about 1 to about 8 carbon atoms. Acetic acid was shown to extract oxidized sulfur compounds from the organic phase and into the aqueous phase. Without acetic acid, no noticeable sulfur transfer into the aqueous phase was observed.

EXAMPLE 7

Hydrotreated refinery distillate S-25 was partitioned by distillation to provide feedstock for oxidation using an immiscible aqueous solution phase containing hydrogen peroxide and acetic acid. The fraction of S-25 collected above temperatures of about 316° C. was a sulfur-rich, monoaromatic-poor fraction identified as S-25-A316. Analyses of S-25-A316 determined a sulfur content of 80 ppm and a nitrogen content of 102 ppm.

A 250 mL, three-neck round bottom flask equipped with a reflux condenser, a magnetic stir bar or mechanical agitator, a nitrogen inlet and outlet, was charged with 100 g of the S-98-25-A316, 75 mL glacial acetic acid, 25 mL water, and 17 mL (30%) hydrogen peroxide. The mixture was heated to 100° C. and stirred vigorously under a very slight flow of house nitrogen for two hours.

At the end of the reaction period, analysis of the top layer (organic) found total sulfur and nitrogen of 54 ppm sulfur and 5 ppm nitrogen. Contents of the flask was again stirred and cooled to room temperature. At room temperature, approximately 0.1 g of manganese dioxide ($MnO_2$) was added to decompose any excess hydrogen peroxide and stirring continued for 10 minutes. The entire contents of the flask were then poured into a bottle with a vented cap. Analysis of the bottom layer (aqueous) found 44 ppm of total sulfur.

EXAMPLE 8

A second oxidation of hydrotreated refinery distillate S-25-A316 was conducted as described in Example 7 by charging 100 mL glacial acetic acid, but no water. The organic layer was found to contain 27 ppm sulfur and 3 ppm nitrogen. The aqueous layer contained 81 ppm sulfur.

EXAMPLE 9

Contents of the flask in both Example 7 and Example 8 were combined. A bottom layer was then removed, leaving behind a combined organic layer from both experiments. The organic layer was dried over anhydrous sodium sulfate to remove any residual water from the process. After the spent sodium sulfate was removed via vacuum filtration, the filtrate was percolated through enough alumina so that the filtrate to alumina ratio ranged from 7:1 to 10:1. Analysis of organic layer emerging from the alumina was 32 ppm of total sulfur and 5 ppm of total nitrogen.

EXAMPLE 10

A hydrotreated refinery distillate identified as S-150 was partitioned by distillation to provide feedstock for oxidations using peracid formed with hydrogen peroxide and acetic acid. Analyses of S-150 determined a sulfur content of 113 ppm and a nitrogen content of 36 ppm. The fraction of S-150 collected above temperatures of about 316° C. was a sulfur-rich, monoaromatic-poor fraction identified as S-150-A316. Analyses of S-150-A316 determined a sulfur content of 580 ppm and a nitrogen content of 147 ppm.

A 3 liter, three neck, round bottom flask equipped with a water-jacketed reflux condenser, a mechanical stirrer, a nitrogen inlet and outlet, and a heating mantel controlled through a variac, was charged with 1 kg of S-98-A316, 1 liter of glacial acetic acid and 170 mL of 30 percent hydrogen peroxide.

A slight flow of nitrogen was initiated and this gas then slowly sweeps over the surface of the reactor content. The agitator was started to provide efficient mixing and the contents were heated. Once the temperature reaches 93° C., the contents were at this temperature for reaction time of 120 minutes.

After the reaction time had elapsed, the contents continued to be stirred while the heating mantel turned off and removed. At approximately 77°C., the agitator was stopped momentarily while approximately 1 g of manganese dioxide ($MnO_2$) was added through one of the necks of the round bottom flask to the biphasic mixture to decompose any unreacted hydrogen peroxide. Mixing of the contents with the agitator was then resumed until the temperature of the mixture has cooled to approximately 49° C. The agitation was ceased to allow both organic (top) and aqueous (bottom) layers to separate, which occurred immediately.

The bottom layer was removed and retained for further analysis in a lightly capped bottle to permit the possible evolution of oxygen from any undecomposed hydrogen peroxide. Analysis of the bottom layer was 252 ppm of sulfur.

The reactor was cautiously charged with 500 mL of saturated aqueous sodium bicarbonate to neutralize the organic layer. After the bicarbonate solution was added, the mixture was stirred rapidly for ten minutes to neutralize any remaining acetic acid. The organic material was dried over anhydrous 3A molecular sieve. Analysis of the dry organic layer, identified as PS-150-A316, was 143 ppm of sulfur, 4 ppm of nitrogen, and a total acid number of 0.11 mg KOH/g.

EXAMPLE 11

A 500 mL separatory funnel was charged with 150 mL of PS-150-A316 and 150 mL of methanol. The funnel was shaken and then the mixture was allowed to separate. The bottom methanol layer was collected and saved for analytical testing. A 50 mL portion of the product was then collected for analytical testing and identified as sample ME11-1.

A 100 mL portion of fresh methanol was added to the funnel containing the remaining 100 mL of product. The funnel was again shaken and the mixture was allowed to separate. The bottom methanol layer was collected and saved for analytical testing. A 50 mL portion of the methanol extracted product was collected for analytical testing and identified as sample ME11-2.

Into the remaining 50 mL of product in the funnel, 50 mL of fresh methanol was added. The funnel was again shaken and the two layers were allowed to separate. The bottom methanol layer was collected and saved for analytical testing. 50 mL of the product is collected for analytical testing and identified as sample ME11-3. The analytical results obtained for this example are shown in Table IV.

TABLE IV

REDUCTION OF SULFUR & TOTAL ACID NUMBER BY METHANOL EXTRACTIONS

| Sample | TAN, mg KOH/g | Sulfur, ppmw |
|---|---|---|
| PS-150-A316 | 0.11 | 143 |
| ME11-1 | 0.02 | 35 |
| ME11-2 | 0.02 | 14 |
| ME11-3 | 0.02 | 7 |

These results clearly show that methanol was capable of selectively removing oxidized sulfur compounds. Additionally, the acidic impurities were also removed by methanol extraction.

EXAMPLE 12

A separatory funnel was charged with 50 mL of PS-150-A316 and 50 mL water. The funnel was shaken and the layers were allowed to separate. The bottom water layer was collected and saved for analytical testing. The hydrocarbon layer was collected for analytical testing and identified as E12-1W. Table V presents these results.

TABLE V

REDUCTION OF SULFUR BY WATER EXTRACTION

| Sample | TAN mg KOH/g | Nitrogen ppmw | Sulfur ppmw |
|---|---|---|---|
| PS-150-A316 | 0.11 | 4 | 143 |
| E12-1W | — | 5 | 100 |

The water extraction results show that water was useful to remove oxidized sulfur compounds in the distillate layer.

EXAMPLE 13

Five hundred grams of PS-150-A316 were percolated through 50 grams of anhydrous acidic alumina. The collected product was identified as E13-1A and analyzed. The data are presented in Table VI.

TABLE VI

REDUCTION OF SULFUR AND NITROGEN BY ALUMINA TREATMENT

| Sample | Nitrogen ppmw | Sulfur ppmw |
|---|---|---|
| PS-150-A316 | 4 | 143 |
| E13-1A | 2 | 32 |

These data demonstrate that alumina treatment was also effective in the removal of residual oxidized sulfur and nitrogen compounds from the distillate.

Analysis was conducted on alumina treated material E13-1A and compared with the PS-150-A316. The analysis showed an absence of any dibenzothiophene or substituted dibenzothiophene in the products, while the feed contained about 3,000 ppm of this impurity.

EXAMPLE 14

Another hydrotreated refinery distillate identified as S-DF was partitioned by distillation to provide feedstock for oxidations using peracid formed with hydrogen peroxide and acetic acid. The fraction of S-DF collected below temperatures of about 288° C. was a sulfur-lean, monoaromatic-rich fraction identified as S-DF-B288. The fraction of S-DF collected above temperatures of about 288° C. was a sulfur-rich, monoaromatic-poor fraction identified as S-DF-A288. Analyses of S-DF-A288 determined a sulfur content of 30 ppm.

A series of oxidation runs were conducted as described in Example 10 and the products combined to provide amounts of material needed for cetane rating and chemical analysis. A flask equipped as in Example 10 was charged with 1 kg of S-DF-A288, 1 liter of glacial acetic acid, 85 mL of deionized and distilled water and 85 mL of 30 percent hydrogen peroxide.

In one procedure a batch of dried oxidized distillate was percolated through a second column packed with 250 mL of dried, acidic alumina (150 mesh). Distillate to alumina ratio was about 4:1 (v/v). The alumina was used for approximately 4 batches of 1,000 mL, and replaced.

In another procedure approximately 100 grams of alumina was placed in a 600 mL Büchner funnel equipped with a fritted disc (fine). Dried distillate was poured over the alumina and more quickly treated as the vacuum draws distillate through the alumina in a shorter time.

Every batch of post-alumina treated material was submitted for total sulfur analysis to quantify the sulfur removal efficiency from the feed. All alumina treated materials had a sulfur concentration of less than 3 ppmw, and in general 1 ppmw sulfur. A blend of 32 batches of post-alumina treated material was identified as BA-DF-A288.

For the purposes of the present invention, "predominantly" is defined as more than about fifty percent. "Substantially" is defined as occurring with sufficient frequency or being present in such proportions as to measurably affect macroscopic properties of an associated compound or system. Where the frequency or proportion for such impact is not clear, substantially is to be regarded as about twenty percent or more. The term "a feedstock consisting essentially of" is defined as at least 95 percent of the feedstock by volume. The term "essentially free of" is defined as absolutely except that small variations which have no more than a negligible effect on macroscopic qualities and final outcome are permitted, typically up to about one percent.

That which is claimed is:

1. A process for the production of refinery transportation fuel or blending components for refinery transportation fuel, which process comprises:

hydrotreating a petroleum distillate consisting essentially of material boiling between about 50° C. and about 425° C. by a process which includes reacting the petroleum distillate with a source of hydrogen at hydrogenation conditions in the presence of a hydrogenation catalyst to assist by hydrogenation removal of sulfur and/or nitrogen from the hydrotreated petroleum distillate;

fractionating the hydrotreated petroleum distillate by distillation to provide at least one low-boiling blending component consisting of a sulfur-lean, mono-aromatic-rich fraction, and a high-boiling feedstock consisting of a sulfur-rich, mono-aromatic-lean fraction;

contacting at least a portion of the high-boiling feedstock with an immiscible aqueous phase comprising at least one organic peracid or precursors of organic peracid, in a liquid reaction mixture maintained substantially free of catalytic active metals and/or active metal-containing compounds and under conditions suitable for oxidation of one or more of the sulfur-containing and/or nitrogen-containing organic compounds at temperatures in a range upward from about 50° C. to about 150° C.;

separating at least a portion of the immiscible peracid-containing phase from the reaction mixture to recover an essentially organic phase from the reaction mixture;

treating at least a portion of the separated peracid-containing phase to remove at least a portion of the sulfur-containing and nitrogen-containing organic compounds and water contained therein, and thereafter recycling to the reaction mixture at least a portion of the treated peracid-containing phase having a water content of less than 60 percent by volume; and treating at least a portion of the recovered organic phase with a solid sorbent, an ion exchange resin, and/or a suitable immiscible liquid containing a solvent or a soluble basic chemical compound, to obtain a product containing less sulfur and/or less nitrogen than the feedstock.

2. The process according to claim 1 wherein the immiscible peracid-containing phase is an aqueous liquid formed by admixing, water, a source of acetic acid, and a source of hydrogen peroxide in amounts which provide at least one mole acetic acid for each mole of hydrogen peroxide.

3. The process according to claim 2 wherein the treating of recovered organic phase includes contacting all or at least a portion of the recovered organic phase with at least one solid sorbent comprising alumina.

4. The process according to claim 2 wherein the treating of recovered organic phase includes contacting all or at least a portion of the recovered organic phase with at least one immiscible liquid comprising a solvent having a dielectric constant in a range from about 24 to about 80 to selectively extract oxidized sulfur-containing and/or nitrogen-containing organic compounds.

5. The process according to claim 4 wherein the solvent comprises a compound selected from the group consisting of water, methanol, ethanol and mixtures thereof.

6. The process according to claim 5 further comprising blending at least a portion of the low-boiling fraction with the product containing less sulfur and/or less nitrogen than the oxidation feedstock to obtain components for refinery blending of a transportation fuel.

7. The process according to claim 2, wherein the treating of recovered organic phase includes contacting all or at least a portion of the recovered organic phase with at least one immiscible liquid comprising an aqueous solution of a soluble basic chemical compound selected from the group consisting of sodium, potassium, barium, calcium and magnesium in the form of hydroxide, carbonate or bicarbonate.

8. The process according to claim 7 wherein the soluble basic chemical compound is sodium bicarbonate, and the treating of the organic phase further comprises subsequent use of at least one other immiscible liquid comprising methanol.

9. The process according to claim 1 wherein the conditions of oxidation include temperatures in a range upward from about 80° C. to about 125° C. and sufficient pressure to maintain the reaction mixture substantially in a liquid phase.

10. The process according to claim 1 wherein the high-boiling oxidation feedstock consists essentially of material boiling between about 200° C. and about 425° C.

11. The process according to claim 1 further comprising blending the product containing less sulfur and/or less nitrogen than the oxidation feedstock with at least a portion of the blending component consisting of a sulfur-lean, mono-aromatic-rich fraction to obtain components for refinery blending of transportation fuels.

12. A process for the production of refinery transportation fuel or blending components for refinery transportation fuel, which process comprises:

hydrotreating a petroleum distillate consisting essentially of material boiling between about 50° C. and about 425° C. by a process which includes reacting the petroleum distillate with a source of hydrogen at hydrogenation conditions in the presence of a hydrogenation catalyst to assist by hydrogenation removal of sulfur and/or nitrogen from the hydrotreated petroleum distillate;

fractionating the hydrotreated petroleum distillate by distillation to provide at least one low-boiling blending component consisting of a sulfur-lean, mono-aromatic-rich fraction, and a high-boiling feedstock consisting of a sulfur-rich, mono-aromatic-lean fraction;

contacting at least a portion of the high-boiling feedstock with an immiscible aqueous phase having a water content of less than 60 percent by volume and comprising at least one organic peracid or precursors of organic peracid, in a liquid reaction mixture maintained substantially free of catalytic active metals and/or active metal-containing compounds and under conditions suitable for oxidation of one or more of the sulfur-containing and/or nitrogen-containing organic compounds at temperatures in a range upward from about 50° C. to about 150° C.;

separating at least a portion of the immiscible peracid-containing phase from the reaction mixture to recover an essentially organic phase from the reaction mixture; and treating at least a portion of the recovered organic phase with a solid sorbent, an ion exchange resin, and/or a suitable immiscible liquid containing a solvent or a soluble basic chemical compound, to obtain a product containing less sulfur and/or less nitrogen than the feedstock.

13. The process according to claim 12 further comprising treating at least a portion of the separated peracid-containing phase to remove at least a portion of the sulfur-containing and nitrogen-containing organic compounds and water contained therein, and thereafter recycling to the reacting mixture at least a portion of the treated peracid-containing phase having a water content of less than 60 percent by volume.

* * * * *